US011299308B2

(12) United States Patent
Cao et al.

(10) Patent No.: US 11,299,308 B2
(45) Date of Patent: Apr. 12, 2022

(54) ELECTRONIC PRODUCT PACKAGING SYSTEM

(71) Applicants: Tyco Electronics (Shanghai) Co. Ltd., Shanghai (CN); TE Connectivity Services GmbH, Schaffhausen (CH)

(72) Inventors: Jian Cao, Shanghai (CN); Lvhai Hu, Shanghai (CN); Dandan Zhang, Shanghai (CN); Fengchun Xie, Shanghai (CN); Yun Liu, Shanghai (CN); Yingcong Deng, Shanghai (CN); Xiaochen Yu, Shanghai (CN); Roberto Francisco-Yi Lu, Bellevue, WA (US)

(73) Assignees: TE Connectivity Services GmbH, Schaffhausen (CH); Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 17/119,453

(22) Filed: Dec. 11, 2020

(65) Prior Publication Data

US 2021/0179305 A1 Jun. 17, 2021

(30) Foreign Application Priority Data

Dec. 11, 2019 (CN) ..... 201911266373.2

(51) Int. Cl.
*B65B 43/46* (2006.01)
*B65B 57/00* (2006.01)
(Continued)

(52) U.S. Cl.
CPC ..... *B65B 43/46* (2013.01); *B65B 5/04* (2013.01); *B65B 5/068* (2013.01); *B65B 23/00* (2013.01);
(Continued)

(58) Field of Classification Search
CPC .. B65B 5/04; B65B 5/068; B65B 5/08; B65B 5/105; B65B 23/00; B65B 25/00;
(Continued)

(56) References Cited

U.S. PATENT DOCUMENTS 3,606,960 A * 9/1971 Butterworth ..... B65B 43/44 221/211
2013/0036716 A1* 2/2013 Tsutsumi et al. ..... B65B 5/04 53/564

(Continued)

FOREIGN PATENT DOCUMENTS

WO WO-2017178924 A1 * 10/2017 ..... B25J 15/0052
WO WO-2019102905 A1 * 5/2019 ..... B65B 43/44

*Primary Examiner* — Stephen F. Gerrity
(74) *Attorney, Agent, or Firm* — Barley Snyder

(57) ABSTRACT

An electronic product packaging system includes a robot on which a vacuum suction device adapted to pick up a packaging box and a gripper adapted to grab an electronic product are disposed, a packaging box loading platform adapted to load a pile of a plurality of the packaging boxes stacked together, a product loading device having a loading groove adapted to load a row of a plurality of the electronic products, and a packaging platform carrying the electronic products and the packaging boxes. The robot is configured to pick up the packaging box from the packaging box loading platform and place the packaging box on the packaging platform with the vacuum suction device. The robot is configured to grab the electronic product from the product loading device and place and pack the electronic product into the packaging box on the packaging platform with the gripper.

16 Claims, 4 Drawing Sheets

(51) Int. Cl.

| | |
|---|---|
| ***B65B 5/04*** | (2006.01) |
| ***B65B 35/16*** | (2006.01) |
| ***B65B 43/44*** | (2006.01) |
| ***B65B 23/00*** | (2006.01) |
| ***B65B 35/02*** | (2006.01) |
| ***B65B 5/06*** | (2006.01) |
| ***B65B 25/00*** | (2006.01) |
| ***B65B 43/18*** | (2006.01) |
| ***B65B 35/18*** | (2006.01) |

(52) U.S. Cl.
CPC ..... *B65B 25/00* (2013.01); *B65B 35/02* (2013.01); *B65B 35/16* (2013.01); *B65B 43/44* (2013.01); *B65B 57/005* (2013.01); *B65B 35/18* (2013.01); *B65B 43/185* (2013.01)

(58) Field of Classification Search
CPC ..... B65B 35/02; B65B 35/16; B65B 35/18; B65B 43/185; B65B 43/44; B65B 43/46; B65B 57/005; B25J 15/0019; B25J 15/0052; B25J 15/0616; B25J 15/0066; Y10S 901/31; Y10S 901/40
USPC ..... 53/168, 250
See application file for complete search history.

(56) References Cited

U.S. PATENT DOCUMENTS

| | | | | |
|---|---|---|---|---|
| 2016/0083129 | A1* | 3/2016 | Prahm et al. | B65B 43/46 53/475 |
| 2017/0057026 | A1* | 3/2017 | Shen et al. | B25J 15/0057 |
| 2020/0198151 | A1* | 6/2020 | Hirata et al. | B65B 43/46 |
| 2020/0376668 | A1* | 12/2020 | Russell | B65B 43/46 |

* cited by examiner

ELECTRONIC PRODUCT PACKAGING SYSTEM

CROSS-REFERENCE TO RELATED APPLICATION

This application claims the benefit of the filing date under 35 U.S.C. § 119(a)-(d) of Chinese Patent Application No. 201911266373.2, filed on Dec. 11, 2019.

FIELD OF THE INVENTION

The present disclosure relates to a packaging system and, more particularly, to an electronic product packaging system.

BACKGROUND

After a connector is manufactured, it is usually placed directly in a plastic bag, and then workers manually pack it into a carton. This existing packaging method is not only inefficient, but also easily damages the connector or the carton during the packaging process.

SUMMARY

An electronic product packaging system includes a robot on which a vacuum suction device adapted to pick up a packaging box and a gripper adapted to grab an electronic product are disposed, a packaging box loading platform adapted to load a pile of a plurality of the packaging boxes stacked together, a product loading device having a loading groove adapted to load a row of a plurality of the electronic products, and a packaging platform carrying the electronic products and the packaging boxes. The robot is configured to pick up the packaging box from the packaging box loading platform and place the packaging box on the packaging platform with the vacuum suction device. The robot is configured to grab the electronic product from the product loading device and place and pack the electronic product into the packaging box on the packaging platform with the gripper.

BRIEF DESCRIPTION OF THE DRAWINGS

The invention will now be described by way of example with reference to the accompanying Figures, of which.

DETAILED DESCRIPTION OF THE EMBODIMENTS

Figure 1:
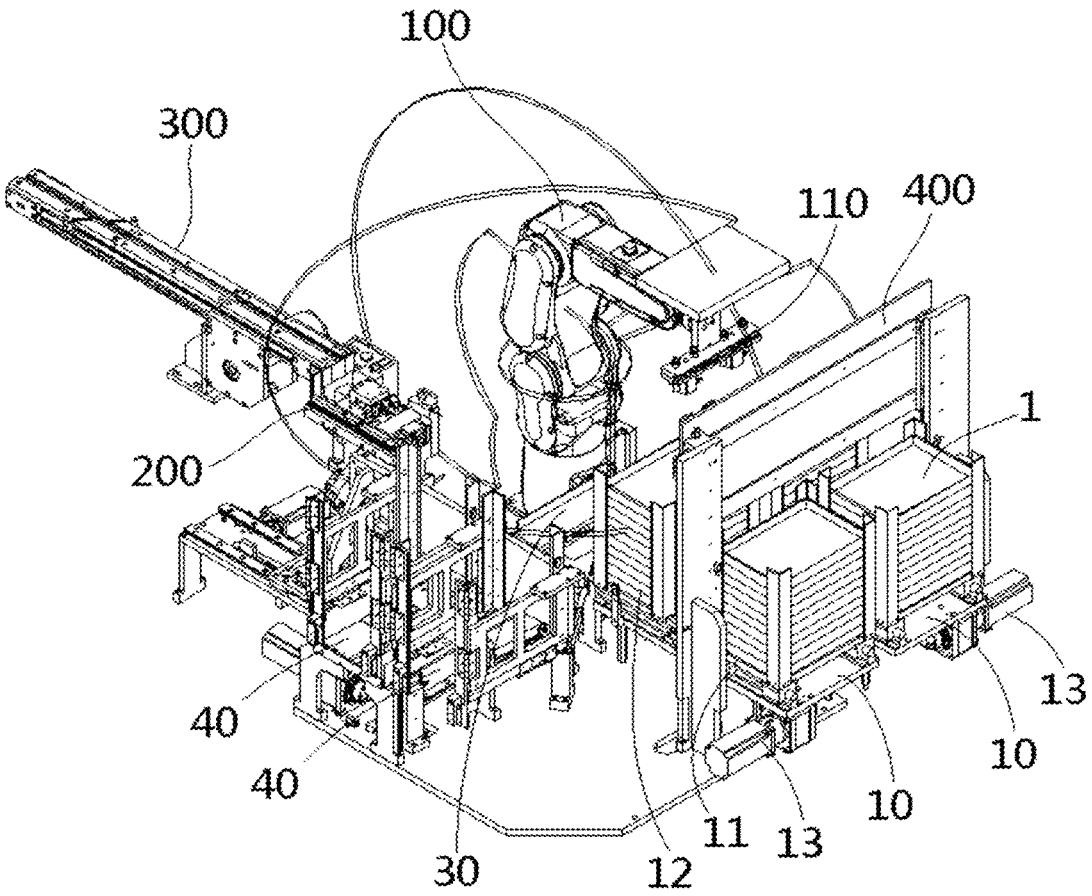
FIG. 1 is a perspective view of an electronic product packaging system according to an embodiment.

The technical scheme of the disclosure is further described in detail by the following embodiments with reference to the accompanying drawings. In the specification, the same or similar reference numerals denote the same or similar components. The following description of the embodiments of the present disclosure with reference to the accompanying drawings is intended to explain the general inventive concept of the disclosure and should not be construed as a limitation of the present disclosure.

In addition, in the following detailed description, for purposes of explanation, numerous specific details are set forth in order to provide a thorough understanding of the embodiments of the disclosure. However, it may be evident, that one or more embodiments may be practiced without these specific details. In other instances, well-known structures and devices are shown in schematic form in order to simplify the drawing.

Figure 2:
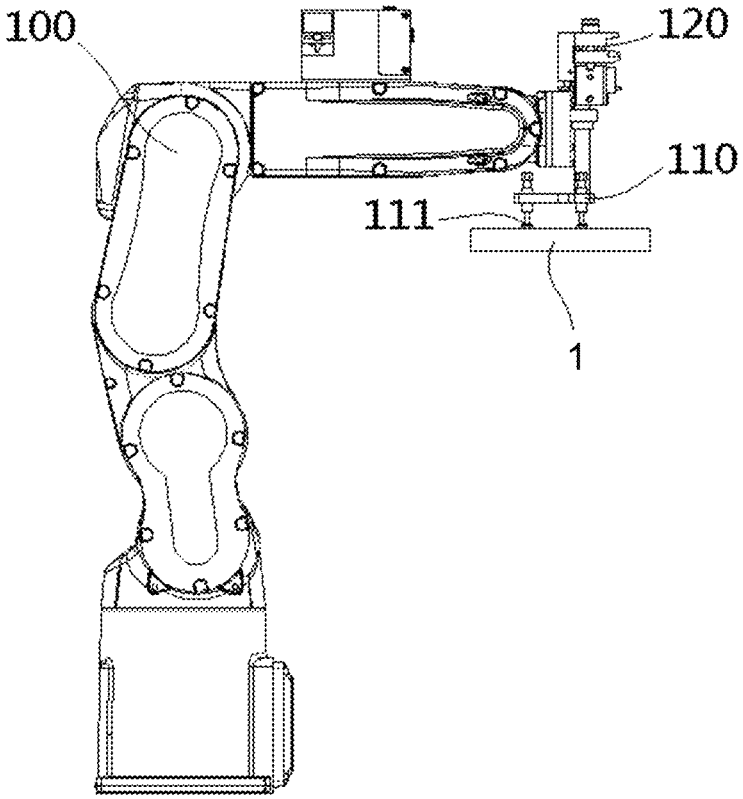
FIG. 2 is a side view of a robot of the electronic product packaging system.
Figure 3:
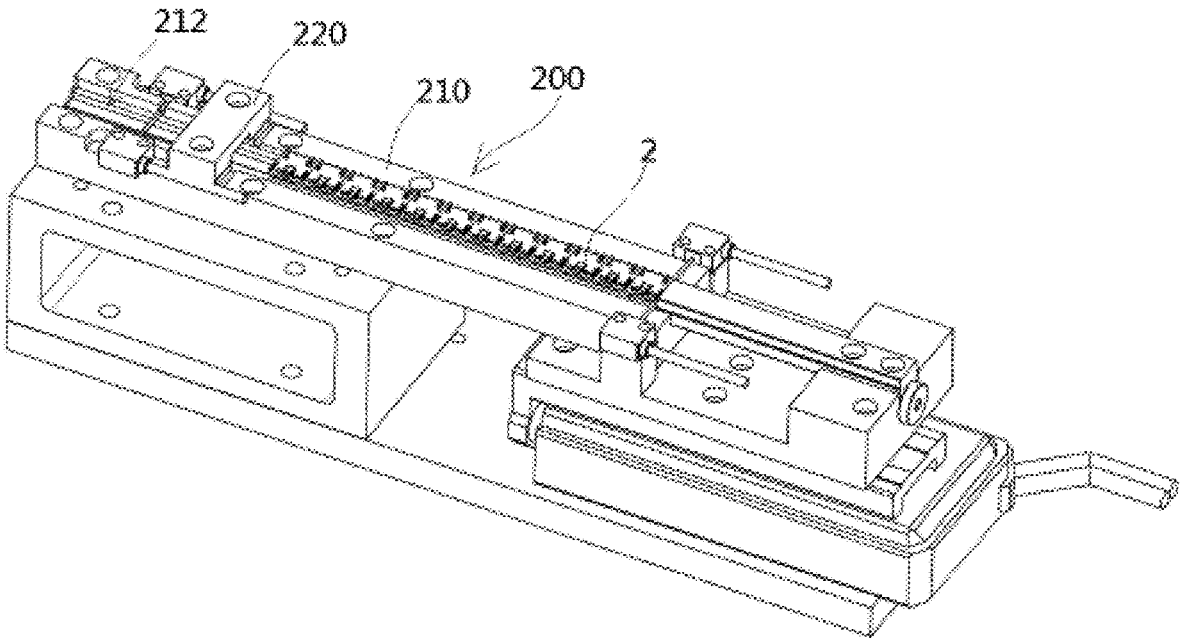
FIG. 3 is a perspective view of a product loading device of the electronic product packaging system.

An electronic product packaging system according to an embodiment, as shown in FIGS. 1 to 3, comprises a robot 100, a packaging box loading platform 10, a product loading device 200 and a packaging platform 30. A vacuum suction device 110 adapted to pick up a packaging box (for example, a carton) 1 and a gripper 120 adapted to grab an electronic product (for example, a connector) 2 are installed on the robot 100. The packaging box loading platform 10 is adapted to load one or more piles of the packaging boxes 1 stacked together. The product loading device 200 has a loading groove 212 adapted to load a row of the electronic products 2. The packaging platform 30 is used to carry the packaged electronic products 2 and the packaging boxes 1.

As shown in FIGS. 1 to 3, in the illustrated embodiment, first, the robot 100 is configured to pick up the packaging box 1 from the packaging box loading platform 10 and place the picked packaging box 1 on the packaging platform 30 with the vacuum suction device 110. Then, the robot 100 is configured to grab the electronic product 2 from the product loading device 200 and place and pack the grabbed electronic product 2 into the packaging box 1 on the packaging platform 30 with the gripper 120.

Figure 4:
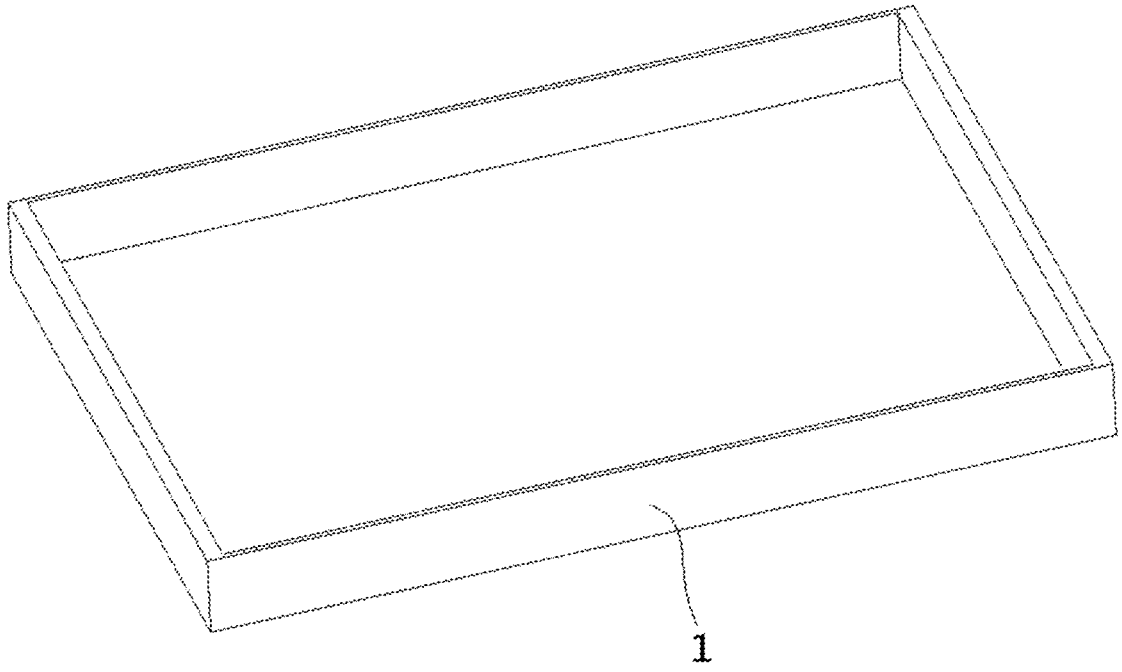
FIG. 4 is a perspective view of a packaging box according to an embodiment.
Figure 5:
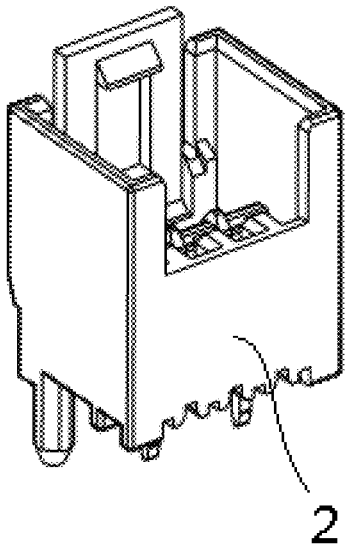
FIG. 5 is a perspective view of an electronic product according to an embodiment.

As shown in FIGS. 4 and 5, in the illustrated embodiment, the electronic product 2 is a connector, and the packaging box 1 is a carton.

As shown in FIGS. 1 to 3, in the illustrated embodiment, the loading groove 212 on the product loading device 200 is adapted to keep the electronic products 2 loaded therein in a predetermined posture (for example, an upright posture or a lying posture), and the predetermined posture is the posture where the electronic products 2 are placed and packaged into the packaging boxes 1.

As shown in FIGS. 1 to 3, in the illustrated embodiment, the product loading device 200 comprises a loading track 210 in which the loading groove 212 is formed, and the electronic products 2 loaded in the loading groove 212 are adapted to slide forward along the loading groove 212.

As shown in FIGS. 1 to 3, in the illustrated embodiment, the product loading device 200 further comprises a pushing mechanism 220, which is adapted to push the electronic products 2 in the loading groove 212 to a predetermined grab location one by one.

As shown in FIGS. 1 to 3, in the illustrated embodiment, the electronic product packaging system comprises two packaging box loading platforms 10 arranged side by side, and the two packaging box loading platforms 10 may simultaneously or alternately load the packaging boxes 1.

As shown in FIGS. 1 to 3, in the illustrated embodiment, the packaging box loading platform 10 comprises a loading area 11 and a picking area 12, the packaging box 1 is first loaded in the loading area 11 and then moved to the picking area 12. The vacuum suction device 110 of the robot 100 is configured to pick up the packaging box 1 from the picking area 12 of the packaging box loading platform 10.

As shown in FIGS. 1 to 3, in the illustrated embodiment, the electronic product packaging system further comprises a propelling device 13. The propelling device 13 is adapted to push the packaging box 1 from the loading area 11 to the picking area 12.

As shown in FIGS. 1 to 3, in the illustrated embodiment, the electronic product packaging system further comprises a safety door 400 that may be opened and closed, and the safety door 400 is located between the loading area 11 and the picking area 12 of the packaging box loading platform 10. When the safety door 400 is closed, the loading area 11 and the picking area 12 of the packaging box loading platform 10 are separated to protect the workers loading the packaging boxes 1 to the loading area 11.

As shown in FIGS. 1 to 3, in the illustrated embodiment, the electronic product packaging system further comprises an unloading platform 40 and a pushing device (not shown), and the pushing device is adapted to push the packaging box 1 on the packaging platform 30 that has been filled with the electronic products 2 fully from the packaging platform 30 to the unloading platform 40.

As shown in FIGS. 1 to 3, in the illustrated embodiment, the electronic product packaging system comprises two unloading platforms 40 arranged side by side, and the two unloading platforms 40 may simultaneously or alternately carry the packaging boxes 1 filled with the electronic products 2 fully.

As shown in FIGS. 1 to 3, in the illustrated embodiment, the vacuum suction device 110 comprises a plurality of vacuum suction nozzles 111, and the plurality of vacuum suction nozzles 111 are adapted to be simultaneously adsorbed on the same surface of the packaging box 1. In an embodiment, the vacuum suction nozzles 111 of the vacuum suction device 110 are formed with a plurality of vacuum suction holes distributed in an array to ensure uniform suction force.

As shown in FIGS. 1 to 3, in the illustrated embodiment, the electronic product packaging system further comprises a product supply device 300. The product supply device 300 is used to supply the electronic products 2 into the loading groove 212 of the product loading device 200. In an embodiment, the product supply device 300 may be a belt conveyor, and the product supply device 300 transports the electronic products 2 to the loading groove 212 of the product loading device 200 one by one through a conveyor belt.

The electronic product packaging system according to the embodiments described above automatically packs electronic products 2 into packaging boxes 1, which improves the packaging efficiency of electronic products 2 without damaging the electronic products 2 and packaging boxes 1.

Those skilled in the art will appreciate that the above-described embodiments are illustrative and can be modified by those skilled in the art, and that the structures described in the various embodiments can be freely combined without conflict in structure or principle. Although the present disclosure has been described with reference to the accompanying drawings, the embodiments disclosed in the drawings are intended to be illustrative explanations of the embodiments of the disclosure, and should not be construed as limiting the disclosure. Although a few embodiments of the present general inventive concept have been shown and described, it would be appreciated by those skilled in the art that changes may be made in these embodiments without departing from the principles and spirit of the present general inventive concept, and the scope of the present disclosure is defined by the claims and their equivalents.

What is claimed is:

1. An electronic product packaging system, comprising:

a robot on which a vacuum suction device adapted to pick up a packaging box and a gripper adapted to grab an electronic product are disposed;

a packaging box loading platform adapted to load a pile of a plurality of the packaging boxes stacked together;

a product loading device having a loading groove adapted to load a row of a plurality of the electronic products; and a packaging platform carrying the electronic products and the packaging boxes, the robot is configured to pick up the packaging box from the packaging box loading platform and place the packaging box on the packaging platform with the vacuum suction device, the robot is configured to grab the electronic product from the product loading device and place and pack the electronic product into the packaging box on the packaging platform with the gripper.

2. The electronic product packaging system of claim 1, wherein the loading groove keeps the electronic products loaded therein in a predetermined posture, the predetermined posture is a posture in which the electronic products are placed and packaged into the packaging boxes.

3. The electronic product packaging system of claim 1, wherein the product loading device includes a loading track in which the loading groove is formed, the electronic products loaded in the loading groove are adapted to slide forward along the loading groove.

4. The electronic product packaging system of claim 3, wherein the product loading device includes a pushing mechanism adapted to push the electronic products in the loading groove to a predetermined grab location one by one.

5. The electronic product packaging system of claim 1, further comprising a pair of packaging box loading platforms arranged side by side, the packaging box loading platforms are configured to simultaneously or alternately load the packaging boxes.

6. The electronic product packaging system of claim 1, wherein the packaging box loading platform has a loading area and a picking area, the packaging box is first loaded in the loading area and then moved to the picking area.

7. The electronic product packaging system of claim 6, wherein the vacuum suction device is configured to pick up the packaging box from the picking area of the packaging box loading platform.

8. The electronic product packaging system of claim 7, further comprising a propelling device adapted to push the packaging box from the loading area to the picking area.

9. The electronic product packaging system of claim 7, further comprising a safety door capable of being opened and closed, the safety door is located between the loading area and the picking area.

10. The electronic product packaging system of claim 9, wherein, when the safety door is closed, the loading area and the picking area of the packaging box loading platform are separated.

11. The electronic product packaging system of claim 1, further comprising an unloading platform and a pushing device adapted to push the packaging box that has been filled with the electronic products from the packaging platform to the unloading platform.

12. The electronic product packaging system of claim 11, further comprising a pair of unloading platforms arranged side by side, the two unloading platforms can simultaneously or alternately carry the packaging boxes filled with the electronic products.

13. The electronic product packaging system of claim 1, wherein the vacuum suction device has a plurality of vacuum suction nozzles, the plurality of vacuum suction nozzles are adapted to be simultaneously adsorbed on a same surface of the packaging box.

14. The electronic product packaging system of claim 13, wherein the vacuum suction nozzles are formed with a plurality of vacuum suction holes distributed in an array to ensure uniform suction force.

15. The electronic product packaging system of claim 1, further comprising a product supply device for supplying the electronic products into the loading groove of the product loading device.

16. The electronic product packaging system of claim 15, wherein the product supply device is a belt conveyor that transports the electronic products to the loading groove of the product loading device one by one through a conveyor belt.

* * * * *